United States Patent [19]

Umeda et al.

[11] Patent Number: 4,833,119

[45] Date of Patent: May 23, 1989

[54] COLOR-DEVELOPING SHEET FOR PRESSURE-SENSITIVE RECORDING SHEETS

[75] Inventors: Hiroaki Umeda; Mamoru Suzuki; Akira Hasegawa; Kunio Hata, all of Tokyo, Japan

[73] Assignee: Jujo Paper Co., Ltd., Tokyo, Japan

[21] Appl. No.: 140,146

[22] Filed: Dec. 29, 1987

[30] Foreign Application Priority Data

Jan. 16, 1987 [JP] Japan ..... 62-7529

[51] Int. Cl.[4] ..... B41M 5/16

[52] U.S. Cl. ..... 503/210; 427/150; 428/342; 428/914; 503/211; 503/212; 503/217; 503/225

[58] Field of Search ..... 427/150–152; 428/914, 341, 342; 503/210–212, 216, 217, 225

[56] References Cited

U.S. PATENT DOCUMENTS 4,749,680 6/1988 Umeda et al. ..... 503/210

FOREIGN PATENT DOCUMENTS 60-159540 7/1985 Japan ..... 503/212

*Primary Examiner*—Bruce H. Hess

*Attorney, Agent, or Firm*—Koda and Androlia

[57] ABSTRACT

The color-developing sheet for pressure-sensitive recording sheets contains a color-developing agent comprising a polyvalent metal salt of aromatic carboxylic acid in combination with a polyvalent metal salt of carboxylated terpenephenol resin and/or a reaction product of carboxylated terpenephenol resin, aromatic carboxylic acid and polyvalent metal compound.

This color-developing sheet provides a higher color-developing rate and a superior color-developing intensity.

8 Claims, No Drawings

COLOR-DEVELOPING SHEET FOR PRESSURE-SENSITIVE RECORDING SHEETS

BACKGROUND OF THE INVENTION

1. Field of the Invention

The present invention relates to a color-developing sheet for pressure sensitive recording sheets using as a color-developing agent a polyvalent metal salt of aromatic carboxylic acid of which the disadvantageous properties are improved.

2. Prior Art

Pressure-sensitive recording sheets are known carbonless copying paper. They produce a color upon the application of a mechanical or impact pressure by writing or by pounding a typewriter, thus permitting duplication of several copies. A colored image is formed by a color developing reaction of a electron-donating colorless dyestuff and a electron-accepting color-developing agent.

Hitherto, many kinds of electron-accepting color-developing agents are well-known. The typical color-developing agents include inorganic solid acids such as acid clay, activated clay, attapulgite (described in U.S. Pat. No. 2,712,597); substituted phenols and diphenols (described in the Japanese Patent Publication No. 9309/1985); p-substituted phenol-formaldehyde polymers (described in the Japanese Patent Publication No. 20144/1967); aromatic carboxylic acid metal salts (described in the Japanese Patent Publication Nos. 10856/1974 and 1327/1977); 2,2'-bisphenol sulfone compounds (described in the Japanese Patent Laid-Open No. 106313/1979); and so on.

Among these color-developing agents, polyvalent metal salts of aromatic carboxylic acids such as 3,6-di-(α-methylbenzyl) salicylic acid zinc salt and the like, have been widely applied for practical use since they have superior resistance of the colored image to light, humidity, heat and plasticizer.

However, the color-developing sheet containing the polyvalent metal salt of aromatic carboxylic acid has the defects that a color-developing rate is slow and a color-developing intensity is low.

SUMMARY OF THE INVENTION

It is an object of the present invention to provide a color-developing sheet containing a polyvalent metal salt of aromatic carboxylic acid as a color-developing agent which has a higher color-developing rate and a superior color-developing intensity.

DETAILED DESCRIPTION OF THE INVENTION

The above object may be performed by using a color-developing agent comprising a polyvalent metal salt of aromatic carboxylic acid in combination with at least one substance selected from the group consisting of a polyvalent metal salt of carboxylated terpenephenol resin and a reaction product of carboxylated terpenephenol resin, aromatic carboxylic acid and polyvalent metal compound. In this case, a color-developing rate and a color-developing intensity are prominently improved under maintaining an excellent fading resistance of a colored image.

The aromatic carboxylic acids which are used in the present invention are the well-known compounds as disclosed in the Japanese Patent Publication Nos. 10856/1974 and 1327/1977.

The aromatic carboxylic acids include, for example, benzoic acid, p-hydroxybenzoic acid, chlorobenzoic acid, bromobenzoic acid, nitrobenzoic acid, methoxybenzoic acid, ethoxybenzoic acid, toluic acid, ethylbenzoic acid, p-n-propylbenzoic acid, p-isopropylbenzoic acid, 3-methyl-4-hydroxybenzoic acid, 3-ethyl-4-hydroxybenzoic acid, 3-methoxy-4-hydroxybenzoic acid, p-tert.-butylbenzoic acid, o-benzoylbenzoic acid, p-cyclohexylbenzoic acid, salicylic acid, 3-methyl-5-tert.-butylsalicyclic acid, 3,5-ditert.-butylsalicylic acid, 5-nonylsalicyclic acid, 5-cyclohexylsalicylic acid, 3-cyclohexylsalicylic acid, 3,5-diamylsalicylic acid, cresotic acid, 5-nonylsalicyclic acid, 5-cumylsalicyclic acid, 3-phenylsalicylic acid, 3,5-sec.-butylsalicylic acid, 2,4-dihydroxybenzoic acid, 2,5-dihydroxybenzoic acid, gallic acid, naphthoic acid, phthalic acid monobenzyl ester, phthalic acid monocyclohexyl ester, salicylosalicylic acid, 3-tert.-butyl-5-α-methylbenzylsalicylic acid, 3,5-di(α-methylbenzyl)salicylic acid, phthalic acid, terephthalic acid, isophthalic acid, diphenic acid, naphthalene dicarboxylic acid, napththalene dicarboxylic acid, naphtholic acid, and the like.

The polyvalent metals used in the present invention include, for example, magnesium, aluminum, cadmium, calcium, titanium, zinc, nickel, cobalt, manganese, vanadium and the like. Magnesium, aluminum and zinc are preferable; and zinc is most preferable.

The polyvalent metal salt of carboxylated terpenephenol resin and a reaction product of carboxylated terpenephenol resin, aromatic carboxylic acid and polyvalent metal salt of this invention are color-developing agents having a novel structure proposed by the inventors, and they are color-developing agents which are superior in yellowing-resistance and plasticizer-resistance.

As described in the Japanese Patent Application No. 159540/1985, the carboxylated terpenephenol resin is prepared by the following process.

The addition reaction of cyclic monoterpene and phenol is carried out in petroleum-solvent in the presence of an acidic catalyst, e.g. aluminum chloride, boron trifluoride, sulfuric acid, polyphosphoric acid, to prepare a condensation product. Cyclic monoterpene used in this invention includes, for example, pinene, limonene, terpinolene, methadiene, gum-turpentine oil which contains α-pinen as main ingredient, dipentene which contains α-limonene as main ingredient, and the like.

Phenol used in this invention includes monophenols, for example, carbolic acid, alkyl-substituted phenols, alkoxy-substituted phenols, halogenated phenols, etc.; and polyvalent phenols, for example, resorcin, catechol, etc.

Petroleum solvent used in this invention includes, for example, benzene, toluene, xylene, n-hexan, n-heptane, halogenized solvent such as dichloromethane, chloroform, trichloroethane, brombenzene, etc. The condensation product is made basic with alkaline metal, alkaline metal hydroxide, or alkaline metal carbonate. The basic condensation product is allowed to react with carbonic acid gas under high temperature (140°-180° C.) and high pressure (5-30 atm.) in an autoclave to introduce carboxy groups. (Kolbe-Schmitt's reaction).

After the completion of reaction, the solvent is removed by a distillation. Meanwhile, the product is cooled to room temperature and washed to separate out the unreactants. The resultant product is extracted with an aqueous alkaline solution. After the neutralization of extracted product, carboxylated terpenephenol resin is separated out. After filtrating and washing, a purified carboxylated terpenephenol resin is obtained.

A polyvalent metal salt of carboxylated terpenephenol resin are prepared by a method which comprises melting the carboxylated terpenephenol resin together with oxide, hydroxide, chloride, carbonate or sulfate of polyvalent metal and inorganic ammonium salt and thereby making them to react, or by a method which comprises dissolving carboxylated terpenephenol resin together with hydroxide of alkali metal in a solvent such as water, alcohol, etc., adding alcohol-soluble polyvalent metal salts thereto and thereby carring out the reaction, or by other methods.

Polyvalent metal used in this invention includes, for example, magnesium, aluminium, calcium, cadmium, titnium, zinc, nickel, cobalt, magnanese etc.

Magnesium, aluminium and zinc are preferable, and zinc is most preferable.

As previously is proposed, the reaction product of carboxylated terpenephenol resin, aromatic carboxylic acid and polyvalent metal compound is prepared either by mixing the carboxylated terpenephenol resin, the aromatic carboxylic acid and polyvalent metal compound uniformly and then causing the reaction thereof, or by mixing above two ingredients uniformly, adding the third ingredient to the mixture and causing a reaction thereof. Uniform mixing is performed by dissolving the ingredients in a solvent under stirring or by melting them under heating, and the like.

Examples for the solvent include aqueous basic solutions such as sodium hydroxide, potassium hydroxide, sodium carbonate, etc.; organic solvents such as alcohol, aceton, etc.; and the mixture thereof.

Aromatic carboxylic acid, in which carboxyl group is bonded to an aromatic ring (mono-ring or polyrings), includes, for example, benzoic acid, p-hydroxybenzoic acid, chlorobenzoic acid, bromobenzoic acid, nitrobenzoic acid, methoxybenzoic acid, ethoxybenzoic acid, toluic acid; ethylbenzoic acid, p-n-propylbenzoic acid, p-isopropylbenzoic acid, 3-methyl-4-hydroxybenzoic acid, 3-ethyl-4-hydroxybenzoic acid, 3-methoxy-4-hydroxybenzoic acid, p-tert.-butylbenzoic acid, o-benzoylbenzoic acid, p-cyclohexylbenzoic acid, salicylic acid, 3-methyl-5-tert.-butylsalicylic acid, 3,5-ditert.-butylsalicylic acid, 5-nonylsalicylic acid, 5-cyclohexylsalicylic acid, 3-cyclohexylsalicylic acid, 3,5-diamylsalicylic acid, cresotic acid, 5-nonylsalicylic acid, 5-cumylsalicylic acid, 3-phenylsalicylic acid, 3,5-sec.-butylsalicylic acid, 2,4-dihydroxybenzoic acid, 2,5-dihydroxybenzoic acid, gallic acid, naphthoic acid, phthalic acid monobenzyl ester, phthalic acid monocyclohexyl ester, salicylosalicylic acid, 3-tert.-butyl-5-α-methylbenzylsalicylic acid, 3,5-di(α-methylbenzyl) salicylic acid, phthalic acid, terephthalic acid, isophthalic acid, diphenic acid, naphthalene dicarboxylic acid, naphtholic acid, and the like.

Among these carboxylic acids, mono-carboylic acids are most preferable.

Polyvalent metal compound used in this invention includes, for example, oxides, halides, carbonates, sulfates, nitrates, acetates, formates, oxalates, benzoates, acetylacetonates, salicylates, etc. of magnesium, aluminum, cadmium, calcium, titanium, zinc, nickel, cobalt, manganese, vanadium and the like. Magnesium compounds, aluminium compounds and zinc compounds are preferable; and zinc compounds is most preferable.

The polyvalent metal salt of a carboxylated terpenephenol resin and/or the reaction product of carboxylated terpenephenol resin, aromatic carboxylic acid and polyalent metal compound, which are used in this invention, are not otherwise limited, and are preferably at least 1 weight %, more preferably at least 30 weight %, based on metal salt of aromatic carboxylic acid.

A coating solution for the color-developing agents is prepared as follows.

(1) Color-developing agents are dispersed with a dispersing agent individually, mixed together, and filler, binder, etc. are added to the mixed color-developing agents.

(2) Color-developing agents are dispersed simultaneously, and filter, binder, etc. are added to the dispersed color-developing agent, or (3) Color-developing agents are mixed, dissolved by heating or in solvent, are dispersed with a dispersing agent, and filler, binder, etc. are added to the dispersed color-developing agents.

A color-developing sheet is prepared by coating the above coating solution as a single layer on a substrate uniformly. However, there may be used multi-layer coating method which comprises applying on a substrate a coating solution containing a color-developing agent, superposing thereon a coating solution containing another color-developing agent and the like.

The color-developing agent of this invention is applied to a wide range of field concerning pressure-sensitive recording sheets, for example, a middle sheet of pressure-sensitive recording sheets, a bottom sheet thereof, a single-type pressure-sensitive recording sheet by coating as laminated layer or as a mixed-state layer; a detecting agent of leuco dyestuff by dissolving this salt in organic solvent; a spot printing ink by mixing this salt with wax, etc.; a pressure-sensitive color-developing ink by encapsulating of color-developing and/or leuco dyestuff; and the like.

The color-developing sheet which contains the color-developing agent of this invention is prepared by the conventionally known method, for example:

(a) applying on a support such as paper, an aqueous coating color in which an aqueous suspension of a color-developing agent is used;

(b) adding the color-developing agent to the stuff in a paper making; and (c) coating on the surface of the support the organic solvent in which a color-developing agent is dissolved or suspended, and then drying the coated supported.

The coating color is produced by mixing kaolin-clays, calcium carbonate, starch, polyvinyl alcohol and synthetic or natural latex, and then giving appropriate viscosity and coating suitability for the mixed materials. It is desirable to use 10 to 70% by weight of the color-developing agent, based on the total solid content in the coating color. If the color-developing agent is less than 10% by weight, the sufficient results cannot be attained. If the color-developing agent is more than 70%, the surface properties of the color-developing sheet is inferior.

The coating weight is more than 0.5 g/m$^2$, preferably 1.0–10 g/m$^2$. The color-developing agent of this invention can be used for the conventionally known pressure-sensitive color-forming dye. Examples of these dyes are as follows.

Triphenylmethane leuco dyes

Crystal violet lactone, malachite green lactone, 3-dimethylamino-triphenylmethanephthalide, and the like.

Fluoran leuco dyes 3,6-dimethoxyfluoran, 3-N-cyclohexylamino-6-chlorofluoran, 3-diethylamino-6-methyl-7-chlorofluoran, 1,2-benzo-6-dimethylaminofluoran, 1,2-benzo-(2',-diethylamino)-6-diethylaminofluoran, 3-diethylamino-7-dibenzylaminofluoran, 3,-diethylamino-6-methyl-7-dibenzylaminofluoran, 3-diethylamino-5-methyl-7-dibenzylaminofluoran, 3-diethylamino-7-aminofluorane, 3-diethylamino-6-methyl-7-anilinofluoran, 3-diethylamino-7-(o-acetyl)anilinofluoran, 3-diethylamino-7-piperidinofluoran, 3-diethylamino-7-pyrolidinofluoran, and the like.

Spiropyran leuco dyes spiro-[3-methylchromene-2,2'-7'-diethylamino chromene], spiro[3-methylchormene-2,2'-7'-dibenzylamino-chromene], 6',8'-dichloro-1-3,3-trimethylindolino-benzospiropyran, 1,3,3-trimethyl-6'-nitrospiro(indoline)-2,2'-2'H chromene, spiro[1,3,3-trimethylindoline-2,3'-8'-bromonaphtho-[2,1-b]pyran], spiro[3-methyl-benzo(5,6-a)chromene-2,2'-7'-diethylaminochromene and the like.

Phenothiazine leuco dyes 3-diethylamino-7(N-methylanilino)-10-benzoyl-phenoxazine; 3,7-bis(dimethylamino)-10-benzoylphenothiazine, 10-(3',4',5'-trimethoxy-benzoyl)-3,7-bis-(dimethylamino)-phenothiazine, and the like.

Phthalide leuco dyes 3-4(diethylamino-2-ethoxyphenyl)-3-(1-ethyl-2-methylindol-3-yl)7-azaphthalide, and the like.

Indol leuco dyes 3,3 bis(1-octyl-2-methylindol-3-yl)phthalide, and the like.

Triphenylmethane leuco dyes

N-butyl-3[bis-4-N-methylanilino)phenyl methyl]carbazole and the like.

[Function]

The present invention improves both color-developing rate and color-developing intensity of a color-developing sheet which are regarded as defects of color-developing sheet containing only a polyvalent metal salt or aromatic carboxylic acid. This reason is probably that a polyvalent metal salt of carboxylated terpenephenol resin or a reaction product of carboxylated terpenephenol resin, aromatic carboxylic acid and polyvalent metal compound has higher color-developing rate and a superior color-developing intensity.

[Examples]

The following examples are given merely as illustrative of this invention and are not to be considered as limiting. All percentages and parts throughout the application are by weight unless otherwise indicated.

The transfer sheet coated with pressure-sensitive dye-containing microcapsules and the evaluation of the color-developing sheet under using this transfer sheet are as follows.

Preparation of a transfer sheet 90 parts of a 10% aqueous solution of an ethylene-maleic anhydride copolymer (trade mark: EMA-31, made by Monsanto Co.) and 90 parts of dilution water were mixed, and 10 parts of urea and 1 part of resorcinol were dissolved in the mixed solution. The obtained solution was adjusted to a pH-value of 3.4

Separately, an oil mixture consisting of alkyldiphenylethane (trade mark: Hysol SAS 296, made by Nisseki chemical Co.) and diisopropylnaphthalene (trade mark: KMC-113, made by Kureha Chemical Co.) in a proportion of 1:1 was prepared.

As two core materials, (a) the oil of blue color-forming dye was prepared by dissolving 3% of crystal weight lactone (CVL) and 1% of benzoyl leuco methylene blue in the above oil mixture, and (b) the oil of black color-forming dye was prepared by dissolving 5% of 3-diethylamino-6-methyl-7-anilinofluoran, 1% of 3-diethylamino-6-methyl-7-diphenylmethylaminofluoran and 0.5% of 3-diethylamino-6-methyl-7-chlorofluoran in the above oil mixture.

180 parts of each of above dye oils were added to the above-produced aqueous solution of a pH-value having 3.4, and emulsified until an average particle size of 4.0 was obtained.

To this emulsion were added 27 parts of 37% formalin and heated to 55° C. After carrying out at encapsulation reaction at 55° C. for 2 hours, the reacted solution was adjusted to a pH-value of 7.5 by the addition of 28% aqueous ammonia solution to prepare two capsule slurries which contains pressure-sensitive dyes.

180 parts of each of the capsule slurries, 40 parts of wheat starch and 85 parts of 8% oxidized starch solution were mixed to prepare two kinds of coating solution.

These coating solutions were independently coated on a fine paper having a basis weight of 45 g/m$^2$ to obtain (a) blue color-forming transfer sheet and (b) black color-forming transfer sheet.

Evaluation of the color-developing sheet

Each of the transfer sheets (a) and (b) and a color-developing sheet are laid so that the coated surfaces of the sheets are faced with each other.

The obtained colored sheets were tested with regard to color-developing rate, end color-developing intensity and light fastness. The test results are summarized in Table 1.

(1) Color-developing rate and color-developing intensity

A CB-sheet coated with microcapsules and a color-developing sheet coated with a color-developing agent are laid so that the two coated surfaces are faced with each other. A pressure is applied to the two sheet by dot-plate roll calender to form a color. The reflectance $I_o$ of the sheet before color development, the reflectance $I_1$ of the sheet of 10 sec after color development, are measured by a Hunter Reflectmeter (manufactured by Toyo Seiki Co.; D type) using an amber filter. The color-developing rate ($J_1$) is expressed by the following equation:

$$\text{Color-developing rate } J_1 = \frac{I_0 - I_1}{I_0} \times 100\ (\%)$$

And color-developing intensity is expressed by the following equation, using the reflectance $I_2$ of the sheet of 24 hours after color development.

$$\text{Color-developing intensity } J_2 = \frac{I_0 - I_2}{I_0} \times 100\ (\%)$$

Higher values of $J_1$ and $J_2$ are preferred.

(EXAMPLE 1)

Preparation of water suspension of color-developing agent 60 parts of 3,5-di(α-methylbenzyl)salicylic acid zinc salt, 40 parts of carboxylated terpenephenol resin zinc salt (manufactured from α-pinene and carbolic acid), 3.5 parts of sodium polyacrylate and 150 parts of water were mixed and then dispersed uniformely to an average particle size of 3μ by means of a sand grinder to prepare a water suspension of color-developing agent.

Preparation of coating solution

Using the obtained water suspension a coating solution having a concentration of 30% (solid) was prepared as follows.

| | |
|---|---|
| Water suspension | 40 parts |
| Calcium carbonate | 100 parts |
| Styrene-butadiene latex (40%) | 15 parts |
| Oxidized starch | 15 parts |
| Water | 415 parts |

Preparation of color developing sheets

The resultant coating color was coated on the base sheet weighing 50 g/m$^2$ at a coating weight of 5.5 g/m$^2$, using Meyer bar.

(EXAMPLE 2)

A water suspension of color-developing agent, a coating solution and a color-developing sheet were prepared in the same manner as in Example 1 except that a reaction product of zinc chloride, salicylic acid and carboxylated terpenephenol resin (manufactured from gum turpentine and carbolic acid) instead of carboxylated terpenephenol resin zinc salt in Example 1 was used.

(EXAMPLE 3)

40 parts of 3,5-di(α-methylbenzyl)salicylic acid zinc salt, 55 parts of carboxylated terpenephenol resin zinc salt (manufactured from α-pinene and carbolic acid), 2.5 parts of sodium hexametaphosphate and 180 parts of water was admixed and dispersed to an average particle size of 2.5 by means of sand grinder to prepare a water suspension of color-developing agent.

Using an above water suspension of color-developing agent, a coating solution and a color-developing sheet were prepared in the same manner as in Example 1.

(EXAMPLE 4)

60 parts of 3,5-di-tert.-butylsalicyclic acid zinc salt, 40 parts of a reaction product of carboxylated terpenephenol resin (manufactured from α-pinene and carbolic acid), 3,5-tert.-butylsalicylic acid and zinc benzoate, 3.6 parts of sodium polyacrylate and 150 parts of water were dispersed to an average particle size of 3.0μ by means of sand grinder to prepare a water suspension of color-developing agent.

Using the above water suspension, a color-developing sheet was prepared in the same manner as in Example 3.

(COMPARATIVE EXAMPLE 1)

100 parts of 3,5-di(α-methylbenzyl)salicylic acid zinc salt, 2.5 parts of sodium polyacrylate and 150 parts of water were dispersed to an average particle size of 3.2μ by means of sand grinder to prepare a water suspension of color-developing agent. A coating solution and a color-developing sheet were prepared in the same manner as in Example 1.

(COMPARATIVE EXAMPLE 2)

A color-developing sheet was prepared in the same manner as in Comparative Example 1 except that 3,4-di-tert.-butylsalicylic acid zinc salt was used instead of 3,5-di(α-methylbenzyl)salicyclic acid zinc salt.

The color-developing sheet of the present invention contains a polyvalent metal salt of an aromatic carboxylic acid in combination with a zinc salt of carboxylated terpenephenol resin and/or a reaction product of carboxylated terpenephenol resin, aromatic carboxylic acid and zinc compound. As seen in Table 1 which showed the test results of color-developing sheets in Examples and Comparative Examples, the color-developing sheet of the present invention provides a higher color-developing rate and a better color-developing intensity than color-developing sheet containing only a polyvalent metal salt of an aromatic carboxylic acid.

TABLE 1

| Example/ Comparative example | Kind of transfer sheet | Color-developing rate [$J_1$] | Color-developing intensity [$J_2$] |
|---|---|---|---|
| Example 1 | A | 41.2 | 54.6 |
| | B | 36.5 | 55.3 |
| Example 2 | A | 42.3 | 53.9 |
| Example 3 | B | 42.5 | 55.0 |
| Example 4 | A | 41.0 | 54.9 |
| | B | 37.0 | 54.4 |
| Comparative Example 1 | A | 39.3 | 51.8 |
| | B | 35.4 | 52.8 |
| Comparative Example 2 | A | 37.1 | 48.5 |

[Effect of the Invention]

As explained above, the color-developing sheet of the present invention provides a higher color-developing rate and a superior color-developing intensity under maintaining a excellent resistance of the colored image to light, humidity, heat and plasticizer, wherein the color-developing sheet containing only polyvalent metal salt of an aromatic carboxylic acid has a low color-developing rate and a inferior color-developing intensity.

We claim:

1. A color-developing sheet for pressure sensitive recording sheet comprising a polyvalent metal salt of aromatic carboxylic acid as a color-developing agent and an electron donating colorless dyestuff as a color-forming agent, said color-developing sheet having on a substrate a polyvalent metal salt of aromatic carboxylic acid in combination with at least one substance selected from the group consisting of a polyvalent metal salt of carboxylated terpenephenol resin and a reaction product of carboxylated terpenephenol resin, aromatic carboxylic acid and polyvalent metal compound.

2. The color-developing sheet according to claim 1, wherein said polyvalent metal is zinc.

3. The color-developing sheet according to claim 1, wherein said substance is at least 1% by weight, based on said polyvalent metal salt of aromatic carboxylic acid.

4. The color-developing sheet according to claim 3, wherein said substance is at least 30% by weight, based on said polyvalent metal salt of aromatic carboxylic acid.

5. The color-developing sheet according to claim 1, wherein said color-developing agent is contained in a range of 10–70% by weight, based on the total solid content in said color-developing layer.

6. The color-developing sheet according to claim 1, wherein the weight of said color-developing layer is 1.0–10.0 g/m$^2$.

7. The color-developing sheet according to claim 1, wherein said color-developing agent is used in combination with at least one dye selected from the group consisting of triphenylmethane leuco dyes, fluoran leuco dyes, spiropyran leuco dyes, phenothiazine leuco dyes, phthalide leuco dyes and indol leuco dyes.

8. The color-developing sheet according to claim 1, wherein said aromatic carboxylic acid is aromatic monocarboxylic acid.

* * * * *